US007827750B2

(12) United States Patent
Sondermann

(10) Patent No.: US 7,827,750 B2
(45) Date of Patent: Nov. 9, 2010

(54) PROFILE-RAIL SYSTEM

(75) Inventor: Frank Sondermann, Drolshagen (DE)

(73) Assignee: Herm, Friedr. Kuenne GmbH & Co., Luedenscheid (DE)

( * ) Notice: Subject to any disclaimer, the term of this patent is extended or adjusted under 35 U.S.C. 154(b) by 460 days.

(21) Appl. No.: 11/642,280

(22) Filed: Dec. 20, 2006

(65) Prior Publication Data

US 2007/0137129 A1 Jun. 21, 2007

(30) Foreign Application Priority Data

Dec. 21, 2005 (DE) ..... 20 2005 020 074 U

(51) Int. Cl.
*E04F 15/14* (2006.01)
*E04F 13/00* (2006.01)

(52) U.S. Cl. ..... 52/396.04; 52/396.05; 52/396.08; 52/396.09

(58) Field of Classification Search ..... 52/395, 52/394, 396.04, 396.05, 396.08, 396.09, 52/393
See application file for complete search history.

(56) References Cited

U.S. PATENT DOCUMENTS 3,183,626 A * 5/1965 Schmitt ..... 52/395
3,344,720 A * 10/1967 Hallock ..... 404/47
3,371,456 A * 3/1968 Balzer et al. ..... 52/278
3,372,521 A * 3/1968 Thom ..... 52/395
3,390,501 A * 7/1968 Driggers ..... 52/395
3,394,639 A * 7/1968 Viehmann ..... 404/47
3,417,528 A * 12/1968 Hallock ..... 52/367
3,435,574 A * 4/1969 Hallock ..... 52/278
3,447,430 A * 6/1969 Gausepohl ..... 404/69
3,474,589 A * 10/1969 Cheatwood ..... 52/698
3,659,390 A * 5/1972 Balzer et al. ..... 52/464
3,750,359 A * 8/1973 Balzer et al. ..... 52/468
3,779,660 A * 12/1973 McGeary et al. ..... 404/69
3,810,707 A * 5/1974 Tungseth et al. ..... 404/67
3,880,539 A * 4/1975 Brown ..... 404/48
4,184,298 A * 1/1980 Balzer et al. ..... 52/396.05
4,221,502 A * 9/1980 Tanikawa ..... 405/126
4,271,650 A * 6/1981 Lynn-Jones ..... 52/395
4,566,242 A * 1/1986 Dunsworth ..... 52/396.01
4,773,791 A * 9/1988 Hartkorn ..... 404/68
4,914,884 A * 4/1990 Ohmatsu ..... 52/396.05
4,925,339 A * 5/1990 Smith ..... 404/47
5,060,439 A * 10/1991 Clements et al. ..... 52/396.07
5,078,529 A * 1/1992 Moulton ..... 403/24

(Continued)

FOREIGN PATENT DOCUMENTS

DE 296 18803 U1 3/1997

(Continued)

*Primary Examiner*—Phi Dieu Tran A
(74) *Attorney, Agent, or Firm*—Robert L. Epstein; Epstein Drangel Bazerman & James, LLP

(57) ABSTRACT

The profile-rail system (1) serves for bridging expansion joints. It is held by means of undercut tongue and groove profilings (3, 4) such that it can be held in a click-in arrangement against flooring elements. In order to obtain a width adjustment and an adjustment to movements of the floor covering, the profile-rail system (1) has at least two telescopable profiled rails (5, 6). These profiled rails (5, 6) can be held against the flooring elements (2) exclusively on the end face.

12 Claims, 1 Drawing Sheet

U.S. PATENT DOCUMENTS

Figure 1:
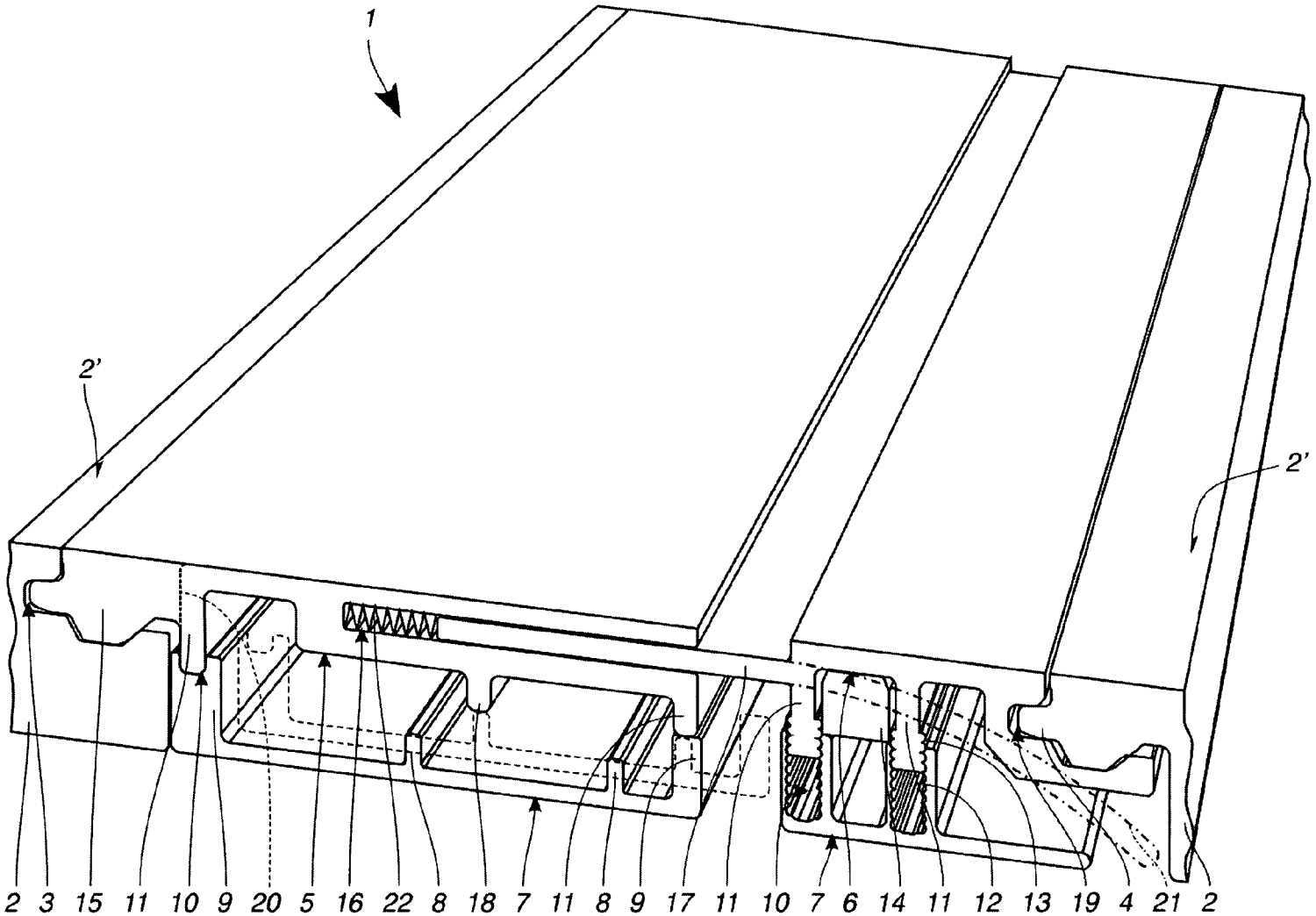

| | | | | | |
|---|---|---|---|---|---|
| 5,224,319 | A | * | 7/1993 | Nicholas | 52/396.05 |
| 5,319,907 | A | * | 6/1994 | Nicholas et al. | 52/396.05 |
| 5,357,727 | A | * | 10/1994 | Duckworth et al. | 52/396.06 |
| 5,365,713 | A | * | 11/1994 | Nicholas et al. | 52/573.1 |
| 5,384,996 | A | * | 1/1995 | Nicholas | 52/468 |
| 5,400,559 | A | * | 3/1995 | Nicholas | 52/396.05 |
| 5,461,838 | A | * | 10/1995 | Heller | 52/396.01 |
| 5,575,126 | A | * | 11/1996 | Attaway et al. | 52/396.02 |
| 5,584,152 | A | * | 12/1996 | Baerveldt | 52/396.05 |
| 5,829,216 | A | * | 11/1998 | Newcomb et al. | 52/395 |
| 5,887,400 | A | * | 3/1999 | Bratek et al. | 52/396.03 |
| 6,345,480 | B1 | * | 2/2002 | Kemper et al. | 52/395 |
| 6,499,265 | B2 | * | 12/2002 | Shreiner | 52/393 |
| 6,581,347 | B1 | * | 6/2003 | Knak et al. | 52/396.04 |
| 6,647,680 | B2 | * | 11/2003 | Daly et al. | 52/287.1 |
| 6,666,618 | B1 | * | 12/2003 | Anaya et al. | 404/68 |
| 6,898,911 | B2 | | 5/2005 | Kornfalt et al. | |
| 6,931,807 | B2 | * | 8/2005 | Braun | 52/393 |
| 6,962,026 | B2 | * | 11/2005 | Knak et al. | 52/396.04 |
| 7,354,219 | B2 | * | 4/2008 | Leonberg | 404/58 |
| 7,389,555 | B2 | * | 6/2008 | Xu | 14/73.1 |
| D574,975 | S | * | 8/2008 | Neuhofer, Jr. | D25/164 |
| 2003/0154678 | A1 | * | 8/2003 | Stanchfield | 52/468 |

FOREIGN PATENT DOCUMENTS

| | | | |
|---|---|---|---|
| DE | 10225579 | A1 | 12/2003 |
| DE | 10254791 | A1 | 6/2004 |
| DE | 202004005 154 | U1 | 9/2004 |
| EP | 1 119 671 | B1 | 9/2005 |
| FR | 2 268 922 | | 11/1975 |

* cited by examiner

PROFILE-RAIL SYSTEM

The invention relates to a profile-rail system for bridging expansion joints, floor covering transitions or recesses or as a wall closure in respect of flooring elements, according to the preamble to Patent claim 1.

From DE 20 2004 000 706 U1, a profile-rail system for bridging flooring covering transitions is known. This profile-rail system comprises three profiled rails, namely a base profile secured in an expansion joint, a hinged profile and a covering profile. The covering profile has two covering wings, which overlap the adjacent flooring elements on the top side. This profile-rail system has proved itself in practice and forms the basis of the present invention.

The object of the invention is to provide a profile-rail system of the type stated in the introduction, which is simple to lay and offers a reduced risk of accident.

This object is achieved according to the invention with the features of Patent claim 1.

The profile-rail system according to the invention serves to bridge expansion joints, but also to bridge recesses between flooring elements. Recesses of this type are found, in particular, in the region of inspection shafts or the like. In addition, it is envisaged to use the profile-rail system as an edge closure or to bridge floor covering transitions. The flooring elements are held one against the other by undercut tongue and groove profilings such that they can be clicked in place, so as to allow an appropriate flooring to be laid with low installation complexity. In order, in particular, to minimize the laying complexity of the profile-rail system, it has at least two mutually telescopable profiled rails. This provides the lasting width adjustment of the profile-rail system which is necessary for expansion joints. Due to the telescopability of the profiled rails, these can easily partake in the displacements of the flooring elements without having to allow a relative displacement of the flooring elements to the profiled rails. It is thereby possible to secure the profiled rails directly to the end face of the flooring elements instead of overlapping the flooring elements. For the connection of the flooring elements to the profiled rails, the latter have, on sides facing away from each other, tongue and groove profilings, which are configured to fit the tongue and groove profilings of the flooring elements. In this way, a continuous floor covering is obtained which, even in the region of the expansion joint or of an inspection shaft, has sufficiently firm connections. Especially in the case of floor covering transitions and edge closures, it is also sufficient to provide the profiling only on one side of the profile-rail system. This is also conceivable if, for other reasons, the securement of the profile-rail system to the end face of the flooring elements is intended to be effected only on one side. For the installation of the profile-rail system, the profiled rails and the flooring elements are easily tilted and the tongue is then pressed into the opposite groove. Hence, the installation of the profile-rail system does not differ substantially from the laying of the flooring elements themselves. The laying of the entire floor covering can therefore easily be carried out even by unskilled persons. In particular, the need to align the profile-rail system exactly to the expansion joint, as is necessary in known profile-rail systems, is eliminated. As a result of the click connection between the flooring elements and the profiled rails, the correct mutual alignment of the two parts is automatically obtained. Since the profiled rails are connected to the flooring elements on the end face, the advantage is further obtained that the profiled rails no longer have to overlap the flooring elements. In this case, the risk of tripping in the region of the profiled rail is correspondingly reduced.

For the simple realization of the desired telescopability of the profiled rails one to another, it is advantageous, if one of the profiled rails has a surface-near web, which intrudes displaceably into a receiving pocket in the opposite profiled rail. In this way, an almost twofold width adjustment of the profile-rail system can be obtained.

In order to ensure a satisfactory contact of the profiled rail against the flooring elements even under difficult installation conditions, it is favourable, to force the profiled rails resiliently apart. Preferably, the spring is provided in the receiving pocket and presses directly against the web.

The web intruding into the receiving pocket inevitably gives rise to a certain vertical offset between the mutually abutting profiled rails. In order to prevent the appearance of the profile-rail system from being excessively spoiled by this vertical offset, it is advantageous, if the profiled rails are grooved on the surface side. As a result of the grooving, the vertical offset is not overly conspicuous, whereby the visual impression is correspondingly enhanced.

In order to eliminate the risk of tripping arising from the profile-rail system, it is favourable, if at least one of the profiled rails lies approximately flush on the top side with the adjacent flooring element. In particular, it is provided to configure the profile-rail system such that at no single point does it jut over the height of the flooring elements. Any tripping on the profiled rails is thereby precluded.

For the adjustment of the profiled rails to different floor covering thicknesses, it is favourable, if the profiled rails are detachably supported on base rails. These base rails can be very easily and thus cheaply profiled. Through an appropriate choice of suitable base rail, any desired thickness of the profile-rail system can be realized to conform to the respective flooring elements.

In order to make the usability of the profile-rail system still more flexible, it is advantageous, if the profiled rails are height-adjustable and lockable in relation to the base rails. A multiplicity of floor covering thicknesses can thus be covered with a combination of profiled rails and base rails. This reduces the manufacturing and storage complexity.

In order to obtain a simple installability of the profile-rail system, it is advantageous, if the profiled rail can be connected to the base rail by means of retaining means. It thus forms a fixed unit and, as such, can be laid without difficulty.

In order to obtain a sufficient rigidity of the profiled rail and base rail, it is favourable, if these have mutually facing stiffening ribs.

In order to be able to use the profile-rail system to bridge floor covering transitions, it is advantageous, if the profiled rails are vertically offset on the top side. Preferably, the vertical offset is located outside the telescope in order to keep the telescopic motion horizontal and not couple it with a vertical motion.

In order to produce a favourable visual impression of the profile-rail system, it is favourable, if the profiled rail is lined on the top side with a decorative foil. This decorative foil is preferably matched to the decorative design of the flooring elements, so that the profile-rail system is barely discernible in the ready-laid flooring.

Further advantages and features of the present invention are explained in the following detailed description with reference to the associated figure, which contain a number of exemplary embodiments of the present invention. It should be understood, however, that the drawing only serves the purpose of illustrating the invention, and does not restrict the scope of protection of the invention.

The single figure shows a perspective representation of a profile-rail system 1 comprising flooring elements 2. The flooring elements 2 have respectively on their end face undercut grooves 3 and tongues 4, which allow installation by means of click connection. The grooves 3 and tongues 4 are configured such that they essentially fit together, a secure connection of the same being able to be created by tilting of one flooring element 2 and subsequent pressing together of both flooring elements 2. In particular, it is thereby not necessary to glue the connection between the flooring elements 2 or to pretension these one against the other. The installation of these flooring elements 2 is therefore also possible by unskilled persons.

The profile-rail system 1 comprises two profiled rails 5, 6 and two base rails 7. The base rails 7 are of substantially U-shaped configuration and have a plurality of stiffening ribs 8, which are directed substantially upwards. The base rails 7 further have edge-side vertical webs 9, in which receiving fixtures 10 can be fixed for the securement of a downwardly directed vertical web 11 of the profiled rails 5, 6. Preferably, the receiving fixtures 10 are configured with a slight undercut in order to realize a secure and yet detachable connection of the profiled rail 5 to the base rail 7. It is envisaged to realize base rails 7 with different structural height in order thereby to realize an individual height adjustment of the profile-rail system 1 to the thickness of the flooring elements 2.

The stiffening ribs 8 of the base rail 7 additionally have the function of realizing a stepped height-adjustability of the profile-rail system 1. If the base rail 7 is brought into the position shown in dashed representation, then the stiffening ribs 8 of the base rail 7 bear against a vertical web and against the stiffening rib 18 of the profiled rail 5. In this way, a smaller structural height of the profile-rail system 1 is realized. Through the omission of the base rail 7, a still smaller structural height can be realized. It is additionally envisaged to provide still further stiffening ribs 18 in order thereby to be able to realize further vertical steps.

In the case of the base rail 7 represented on the right, a fine-stepped, individual height adjustability of the profiled rail 6 is alternatively shown. For this purpose, the receiving fixture 10 has a toothing 12, which corresponds to a toothing 13 of the vertical web 11 of the profiled rail 6. According to the depth to which the vertical web 11 is pressed into the receiving fixture 10, an individual height adjustment of the profile-rail system 1 can thereby be made with unchanged profiled rails. In order to obtain a sufficient step load capacity of the profile-rail system 1, the profiled rail 6 and the base rail 7 can be glued together. Alternatively, it is also envisaged to insert between the two of them a fitting strip 14, which is supported, on the one hand, on the vertical webs 9 of the base rail 7 and, on the other hand, against the profiled rail 6. A fitting strip 14 of this type is of very simple construction and can be made for different heights at low cost. This fitting strip 14 prevents unwanted pressings of the vertical web 11 into the receiving fixture 10 when a step load arises.

The profiled rail 5 is fixedly connected by its vertical webs 11 to the base rail 7. On the edge side it has a tongue 15, which is configured substantially like the tongue 4 of the flooring elements 2. The tongue 15 is here shaped such that the profiled rail 5 can be installed by angular setting of the profiled rail 5 and of the flooring element 2 relative to each other and subsequent pressing of the tongue 15 into the groove 3.

The profiled rail 5 further has a receiving pocket 16, which forms a slide guide for a web 17 of the profiled rail 6. The profile-rail system thus forms a complete covering of the sub-floor, the profiled rails 5, 6 being mutually telescopable. This allows a desired width adjustment of the expansion joint held freely between the flooring elements 2. The profiled rail 5 further has a stiffening rib 18, which is directed vertically downwards.

The profiled rail 6 has on its end region an undercut groove 19, which is configured substantially like the groove 3 of the flooring elements 2. The two profiled rails 5, 6 can thus be connected to the flooring elements 2 by a corresponding click connection. The connection is here made exclusively on the end face. The profiled rails 5, 6 are here configured such that on the top side they run flush with a surface 2' of the flooring elements 2.

Through the omission of the tongue 15 or of the profile around the groove 19, an edge closure profile can be very easily realized. This is indicated in the figure by the dashed line 20. This modification is also advantageous in those cases in which only a one-sided securement of the profile-rail system is intended to be made. In order here to obtain a clean contact of the profiled rail 6 against the adjoining flooring element or against a wall, the web 17 is pressed by a spring provided in the receiving pocket 16 elastically out of the latter. Alternatively, the profiled rail 6 can also be secured to the sub-floor, in particular screwed or glued thereto.

In addition, the profiled rail 5, 6 can also be drawn downwards in order to produce a height-equalizing branch 21 indicated in dash-dot representation. This runs flush with the web 17, so that no step is any longer obtained on the top side of the profiled rail 6.

Since a number of exemplary embodiments of the present invention have not been shown or described, it should be understood that a large number of changes and modifications to these exemplary embodiments described are possible without departing from the essential idea and the scope of protection of the invention defined by the claims.

REFERENCE SYMBOL LIST

1 profile-rail system
2 flooring element
2' surface
3 groove
4 tongue
5, 6 profiled rail
7 base rail
8 stiffening rib
9 vertical web
10 receiving fixture
11 vertical web
12, 13 toothing
14 fitting strip
15 tongue
16 receiving pocket
17 web
18 stiffening rib
19 groove
20 dashed line
21 height-equalizing branch
22 spring

The invention claimed is:

1. Profile-rail system for at least one of bridging expansion joints, recesses, and as an edge closure in respect of flooring elements which are held one against the other by undercut tongue and groove profilings such that they can be clicked in place, said profile-rail system having at least two mutually telescopable profiled rails, at least one of which having a surface-near web, which intrudes displaceably into a receiving pocket in the opposite profiled rail, at least one of said profiled rails having a profiling on the end side facing the flooring elements, said profiling containing at least one of an undercut tongue and a groove which is configured to fit the tongue and groove profiling of the flooring elements to enable the profiled rails to be connected to the flooring elements on the end face by tilting and pressing of the tongue into the opposite groove, at least one of said profiled rails comprising multiple downwardly extending webs and said profile-rail system having base rails comprising multiple vertical webs, at least one of said base rails being positioned below said receiving pocket, said multiple downwardly extending webs of said profile rails being detachably mounted on said base rails in different respective positions, namely in a first position, wherein said downwardly extending webs are bearing against said vertical webs, and in a second position, wherein said downwardly extending webs are not bearing against said vertical webs, so as to realize the function of a height-adjustability of said receiving pocket and surface-near web.

2. The profile-rail system according to claim 1, characterized in that said profiled rails are forced resiliently apart.

3. The profile-rail system according to claims 1, characterized in that said profiled rails are grooved on the surface side.

4. The profile-rail system according to claim 1, characterized in that at least one of said profiled rails lies substantially flush on the surface side with the adjacent flooring element (2).

5. The profile-rail system according to claim 1, characterized in that said profiled rails being height-adjustable and lockable in relation to said base rails (7).

6. The profile-rail system according to claim 1, characterized in that said profiled rail is connected to said base rail.

7. The profile-rail system according to claim 1, characterized in that said profiled rail is adapted to be connected to a sub-floor.

8. The profile-rail system according to claim 1, characterized in that said profiled rails having mutually facing stiffening ribs.

9. The profile-rail system according to claim 1, characterized in that said base rails having mutually facing stiffening ribs.

10. The profile-rail system according to claim 1, characterized in that said profiled rails being vertically offset on the top side for adjustment to different floor covering heights.

11. The profile-rail system according to claim 1, characterized in that said profiled rails are decoratively lined on the top side, such that the rails are able to match to the decorative design of said flooring elements.

12. The profile-rail system according to claim 1, characterized in that said profiled rail is adapted to connect flooring element exclusively on said end face and reaches at most up to a surface of the flooring element.

* * * * *